United States Patent [19]

Wolcott

[11] Patent Number: 4,688,607

[45] Date of Patent: Aug. 25, 1987

[54] BANDING TOOL

[75] Inventor: Wayne B. Wolcott, Englewood, Ohio

[73] Assignee: Electro Adapter, Chatsworth, Calif.

[21] Appl. No.: 758,598

[22] Filed: Jul. 24, 1985

[51] Int. Cl.[4] ..... B21F 9/02

[52] U.S. Cl. ..... 140/93.2; 140/152; 140/154

[58] Field of Search ..... 140/93.2, 123.5, 123.6, 140/150, 152, 154; 81/9.3

[56] References Cited

U.S. PATENT DOCUMENTS

| | | | |
|---|---|---|---|
| 2,175,478 | 10/1939 | McKee | 81/9.3 |
| 2,622,460 | 12/1952 | Keeble | 140/93.2 |
| 2,743,634 | 5/1956 | Badeau | 74/581 |
| 2,882,934 | 4/1959 | Gerrard | 140/93.2 |
| 3,433,275 | 3/1969 | Eppler | 140/93.2 |
| 3,648,739 | 3/1972 | Angarola | 140/93.2 |
| 3,661,187 | 5/1972 | Caveney et al. | 140/123.6 |
| 3,712,346 | 1/1973 | Noorily | 140/93.2 |
| 3,752,199 | 8/1973 | Fekete | 140/93.2 |
| 3,782,426 | 1/1974 | Morgan et al. | 140/93.2 |
| 3,853,155 | 12/1974 | Kabel | 140/93.2 |
| 4,047,545 | 9/1977 | Paradis | 140/93.2 |

FOREIGN PATENT DOCUMENTS

| | | | |
|---|---|---|---|
| 2946718 | 5/1981 | Fed. Rep. of Germany | 140/123.6 |
| 1117500 | 5/1956 | France | 140/123.6 |

*Primary Examiner*—Lowell A. Larson

*Attorney, Agent, or Firm*—Harris, Kern, Wallen & Tinsley

[57] ABSTRACT

A tool for tightening a band to a predetermined tension about an article by pulling the band through a buckle thereon includes a reciprocable feeder within a housing for gripping the band, incrementally pulling it into the housing, releasing it and then regripping it at another position while it is held by a supplemental grip within the housing. A handle pivotally mounted in the housing operates the reciprocable feeder through an operative connection responsive to the tension of the band in such manner that when a predetermined tension has been reached, the operative connection is disengaged while the band remains gripped by the feeder. The handle which operates the feeder may then be swung in the opposite direction to actuate a member which pushes the wrapped article around the nose of the tool in such manner as to bend the band about its buckle and thus to retain the desired tension therein, after which the band may be cut off at a position within the nose of the housing.

A special feature of the tool is the construction and arrangement of the member responsive to tension for controlling the operative connection to the feeder, which comprises a plurality of Bellville washers arranged in series in such manner that when their preset thrust force has been overcome, they collapse and thereby release the connection between the handle and the feeder.

21 Claims, 16 Drawing Figures

BANDING TOOL

BACKGROUND OF THE INVENTION

The present invention relates to a banding tool and, more particularly, to a banding tool and method of using the banding tool for banding an article to a predetermined band pressure or tension and then automatically locking that band tension about the article.

The ability to tighten and lock a band automatically about an article within predetermined tension limits is a very desirable feature from the standpoint of accuracy ard ease of operation. No banding tools are presently known which incorporate these features.

Banding tools are well-known and are used for a wide variety of banding operations. However, a disadvantage of these banding tools is that they are unable to insure consistently that a predetermined band tension is attained, operation after operation. For example, one such tool consists of two rotary wheels with teeth operatively connected to arms operating in a scissors-like manner. Banding material is initially fed between the rotary wheels. The arms are alternatively compressed and released while pulling the banding material into the tool until the banding material has been tightened about the article.

A disadvantage of this type of banding tool is that no mechanism is provided for predetermining a tension limit for the banding material about the article and then once that tension is attained, for automatically locking that tension into the banding material about the article. Basically, with this type of tool, the tension of this banding material about the article is a function of the operator's judgment and experience.

Accordingly, there is a need for a banding tool which provides the ability, independent of the banding tool operator, to band an article at a predetermined tension and then once that predetermined tension is attained, to effect automatic locking on that predetermined tension on the band about the article.

SUMMARY OF THE INVENTION

The present invention provides a banding tool and method of operation designed to satisfy the aforementioned needs. The invention embodies a unique tension actuator unit that is simple, compact and may be utilized over a wide range of predetermined tension ranges. Furthermore, the banding tool of the present invention is totally independent of the operator for repeatedly accurately determining the banding material tension about the article.

Accordingly, the present invention relates to a banding tool for tightening and securing banding material about an article within predetermined tension limits and for locking that tension once the predetermined tension has been attained, which includes means for receiving the banding material, means for incrementally advancing the banding material through the tool, means for securing the banding material within the tool as the banding material is being tightened about an article, means for predetermining tension limits and for precisely determining when that predetermined tension of the banding material about the article has been reached, and means for locking the predetermined tension into the banding material about the article once the predetermined tension is attained about the article.

A further aspect of the present invention relates to providing means for bending the banding material so that after the predetermined tension has been attained and the means for precisely locking has been actuated, the predetermined tension will be maintained about the article.

A still further aspect of the present invention relates to providing a tool which includes means for severing the excess banding material from the band about the article while maintaining the predetermined tension about the article.

While the present invention may be embodied in tools for a plurality of different applications, one example, which was designed for application in aerospace electronic wiring systems, is as a hand operated tool for tightening, locking and trimming an electro adapter band onto backshells within a tension range from 75 to 175 pounds. After the tension range has been locked in the band about the material, the tool bends the excess banding material so that the tension is locked in the band about the backshell. Finally, the tool is used to sever the excess banding material from the band about the backshell.

Accordingly, it is an object of the present invention to provide a banding tool which may be utilized with a wide varity of banding materials, and to provide a banding tool which allows for accurate predetermined tension limits to be set, and once attained, to effect automatic locking of the predetermined tension into and about an article independent of the banding tool operator.

Other objects and advantages of the invention will be apparent from the following description, the accompanying drawings and the appended claims.

DETAILED DESCRIPTION OF THE PREFERRED EMBODIMENT

Figure 1:
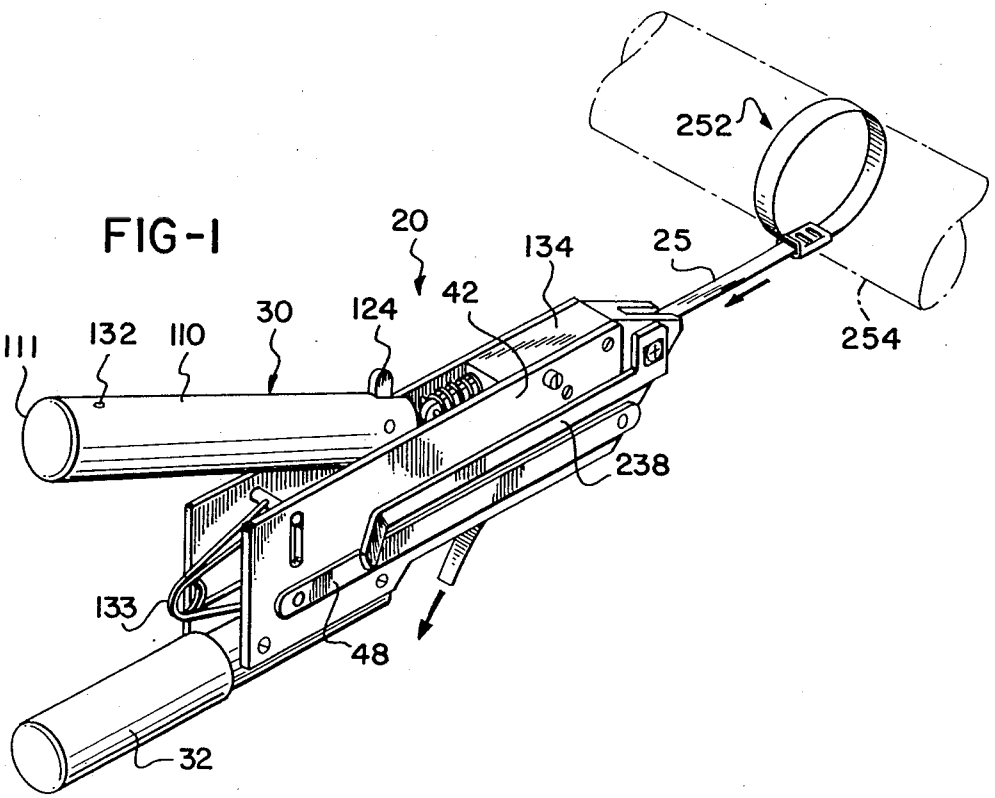
FIG. 1 is a view in side elevation of a tool embodying this invention.

Referring now to the drawings and specifically to FIGS. 1-5, banding tool 20 consists of the following major elements: banding material receiving housing 22, first banding material gripping element 24 for incrementally advancing the banding material 250 into the tool, second banding material gripping element 26 for preventing the banding material once advanced into the tool from slipping back out, tension actuator unit 28 for setting the predetermined tension and locking the tension on the band about the article once that tension is attained, and two scissor grip members 30, 32 for operating the first banding material gripping element 24 and the tension actuator unit 28.

Figure 2:
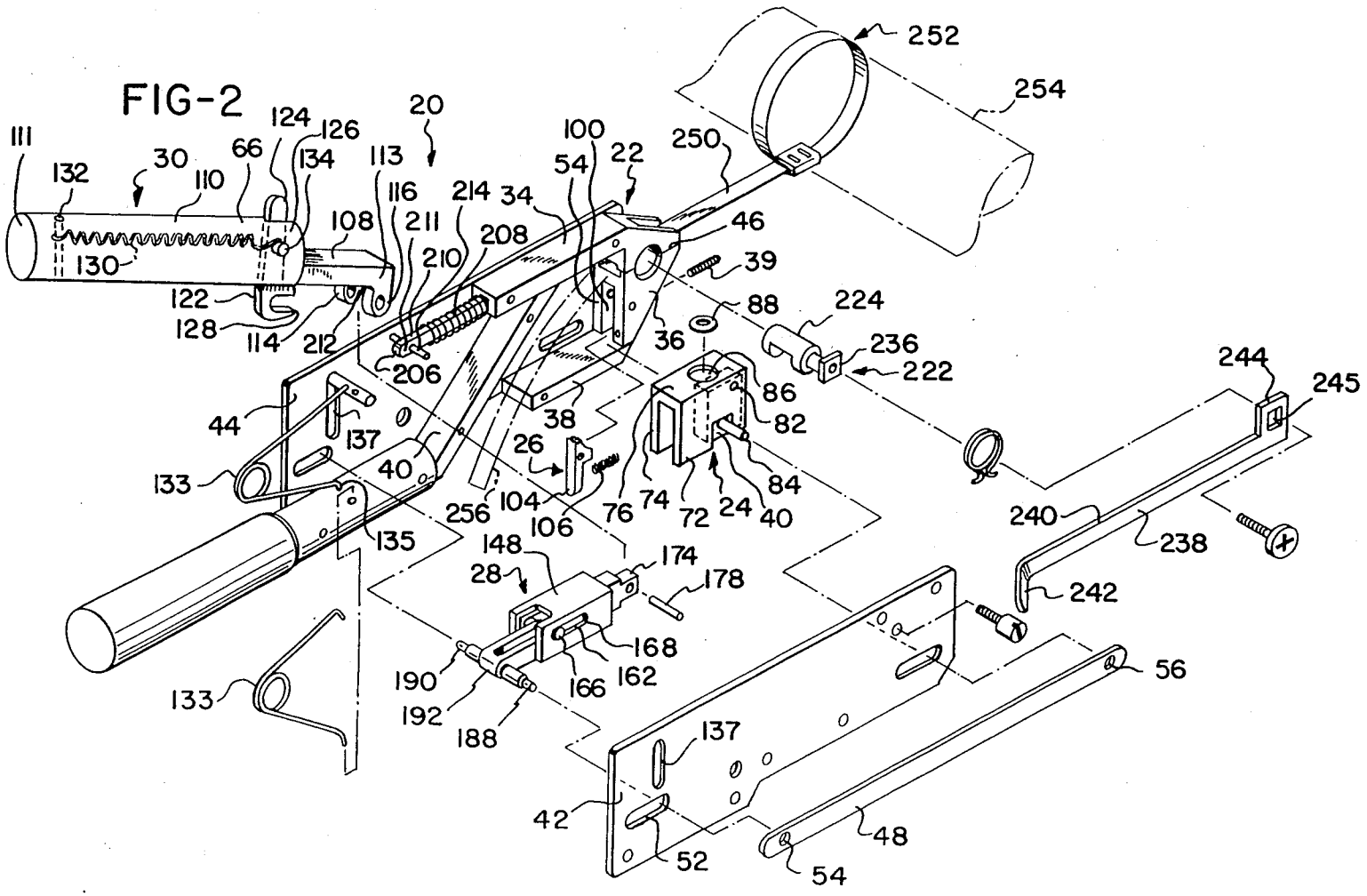
FIG. 2 is an exploded perspective view of the tool of the present invention.

Means are provided for receiving and guiding the banding material 25 into banding tool 20. In FIG. 2, banding material receiving housing 22 consists of an upper receiving housing member 34, a lower receiving housing member 36, a lower elongated member 38, a rear elongated member 40 and two side members 42 and 44. As shown, the housing members 34-36 at the front end of the tool form a generally triangular nose.

Figures 3, 4, 5, 14:
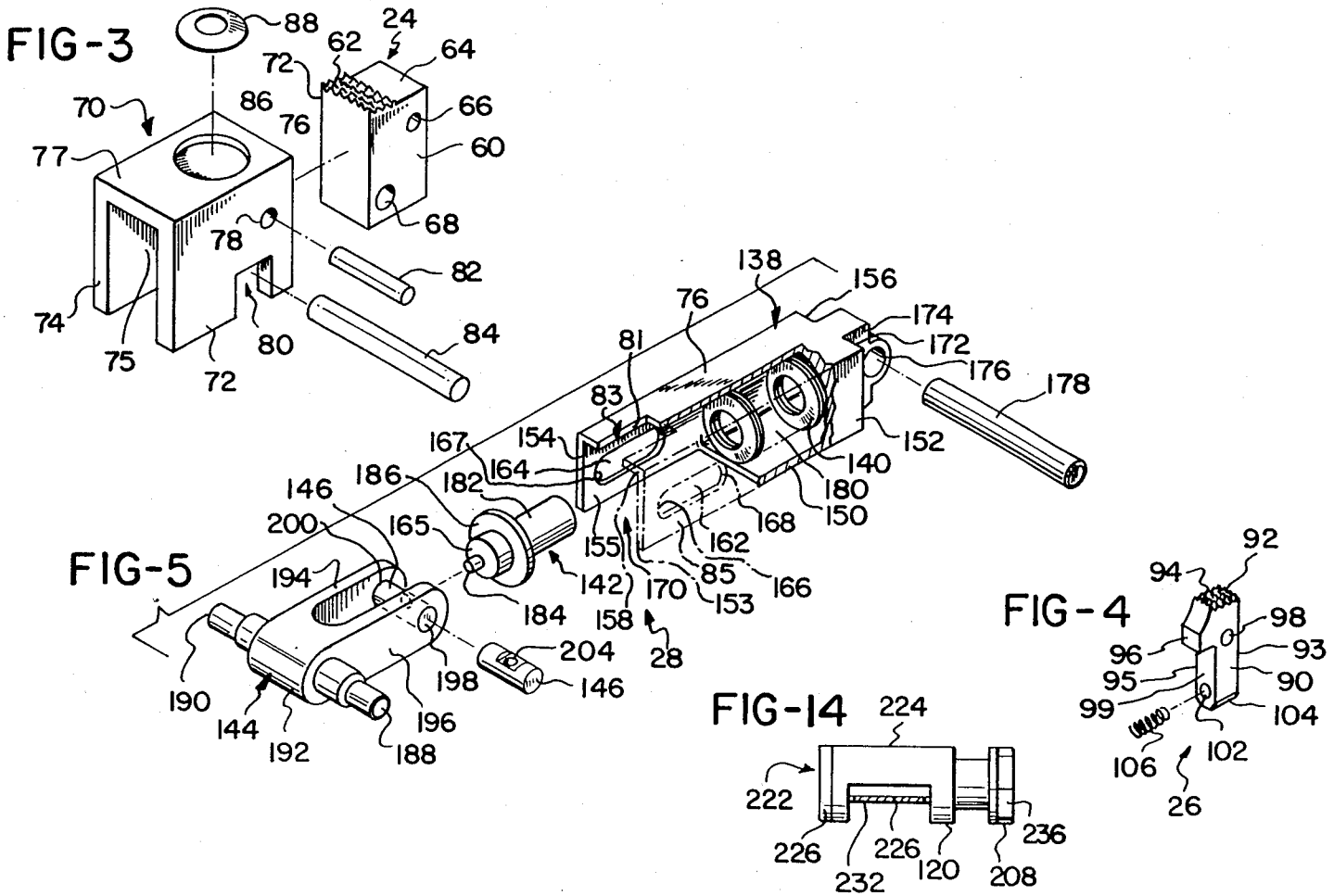
FIG. 3 is an exploded perspective view of the first gripping element in the tool of FIG. 2.
FIG. 4 is an exploded perspective view of the second gripping element in the tool of FIGS. 1–2.
FIG. 5 is an exploded perspective sectional view of the tension actuator unit.
FIG. 14 is a detailed perspective elevation view of the cylindrical cutting member showing the recess in registration with the channel and the banding material being fed through the channel.

A channel 46 is initially formed between the upper receiving housing 34 and the lower receiving housing 36. The channel 46 can be initially sized to accommodate a plurality of different sized banding materials 25 or once initially sized, the channel 46 can be made adjustable to accommodate a plurality of different sized banding materials 25 smaller than the initial size. As illustrated in FIG. 14, this is accomplished by one or more bores 45 drilled in upper receiver housing 34 and threaded to receive threaded removable screws 54 therein. A plurality of bores can be drilled into upper receiver housing 34, as required.

Lower receiving housing 36 has a bore 37 drilled therein (see FIG. 15) for receiving an adjusting member 39. The importance of the adjusting member will be explained later.

In the preferred embodiment, the upper and lower housings 34 and 36 are connected to form the channel 46 at their junction. However, it is understood that the banding material receiving housing 22 could consist of only one member or a plurality of members.

Means are provided for making the banding tool 20 rigid and for interconnecting the various housing components. In the embodiment illustrated in FIGS. 1 and 2, this consists of two side members 42, 44 and two identical linking members 48.

As illustrated in FIG. 2, the generally planar side members 42, 44 each have means for connecting them to the other tool components. Each member 42, 44 has two identical rectangular shaped cut-outs 50, 52. The front cut-out 50 is located proximate the front end portion of each member 42, 44, and the rear cut-out 52 is located proximate the rear end portion of each member 42, 44. These cut-outs 42, 44 provide for the interconnection of the tension actuator unit 28 with the first gripping element 26 via the two linking members 48.

The two side members 42, 44 are connected to the receiving housing 22. The two side members 42, 44, along with upper receiving member 34, lower receiving member 36, lower elongated member 40 and rear elongated member 38, define an operating channel 54 for the first gripping element 24.

The two linking members 48 are generally elongated bars with rounded ends having apertures 54, 56 proximate each end. The specific relationship between the linking members 48, the cut-outs 50, 52, the side walls 42, 44, the actuator unit 28 and the first gripping element 24 will be explained later.

Means are provided for gripping the banding material 25 and for incrementally advancing the banding material 25 about an article 254 and through the banding channel 46. In the embodiment illustrated in FIG. 3, first gripping element 24 consists of a generally rectangular gripping member 60 having a plurality of teeth 62 located on upper small surface 64. The teeth 62, preferably made from S7 steel, are located on approximately half of the upper surface 64 of the gripping member 60 and are oriented at approximately a 30° angle with respect to the direction of feed, as indicated by the arrow in FIG. 1, of the banding material 25. The first gripping member 60 has two bores 66, 68 drilled approximately perpendicular between sides 70 and 72 of the rectangular gripping member 60.

A U-shaped gripping member housing 70 (FIG. 2) is used to mount the first gripping member 60 inside operating chamber 54. The first gripping member housing 70 consists of two generally rectangular side walls 72, 74 connected by an upper generally rectangular top wall 76. Each housing side wall 72, 74 has a bore 78 drilled therein coinciding with the aforementioned bore 66 and an approximately rectangular cut-out portion 80 in the gripping member 70. Pivot pin 82 is inserted through bores 78 and 66 to anchor gripping member 60 inside housing 70. Connecting pin 84 is inserted through cut-out portion 80 and bore 68 to limit the degree of pivot of the gripping member 60 precisely within the housing 70. First gripping member 60 is positioned inside housing 70 so that there is sufficient clearance between teeth 62 and the inside surface 75 of top wall 76 for the banding member to pass smoothly therebetween.

A circular recess 86 is drilled in the outer surface 77 of the top wall 76 of the gripping member housing 70. A tension washer 88 is positioned in the recess 86 for providing drag between the first gripping housing 70 and the upper receiving housing member 34. As the first gripping element 24 is moved within the operating chamber 54 (FIG. 2), the drag provided by this tension washer 88 prevents the gripping member housing 70 from locking up in chamber 54 during operation.

Means are provided for preventing the banding material 25 advanced into the channel 46, from slipping back between each incremental advancement. In FIGS. 2 and 4, the second gripping element 26 consists of a generally rectangular gripping member 90 having a plurality of teeth 92 on the top end surface 94 and a notch 96 proximate the top end surface 94. The teeth 92, preferably made from S7 steel, are oriented at approximately a 30° angle relative to the direction of feed of the banding material 25.

The second gripping member 90 has a bore 98 drilled approximately perpendicularly through the two larger side surfaces 93, 95 and proximate the top end surface 94. The bore 98 is used to pivotally connect the second gripper member 90 inside a cavity 100 (FIG. 2) in the lower housing 36 directly below the banding material feed channel 46.

The second griping member 90 also has a partial bore 102 drilled on smaller side surface 99 perpendicular to the bore 98 located proximate the bottom end surface 104. A spring member 106 is positioned in the partial bore 102 and biases the second gripping member 90 into contact with any banding material 25 in channel 46 directly above the gripping member 90. The teeth 92 of second gripping member 90 are designed such that the second gripping member teeth 92 do not engage the banding material 25 as the banding material 25 is being fed into the banding tool 20 but do engage the banding material 25 between each incremental advancement. Thus second gripping element 26 prevents the banding material 25 which has already been fed into the banding tool 20 from slipping back toward the article 254.

Means are provided for incrementally advancing the banding material 25 into the tool 20 by alternately engaging and disengaging the first gripping element 24 and the second gripping element 26 with the banding material 25. In FIGS. 1 and 2 and 5–12, this consists of two scissor grip members 30, 32. Upper scissors grip member 30 consists of two portions 108, 110. The first portion 108 is generally planar and has a U-shaped member 112 extending from one end 113. Each leg 114, 116 of U-shaped member 112 has an aperture 118. The first portion 108 is connected to a generally cylindrical second portion 110.

Upper scissors grip member 30 has a hook-shaped member 122 extending perpendicularly from outside and through both the rectangular shaped portion 108 and the cylindrical shaped portion 110. The hook-shaped member 122 has the tip 124 extending above the surface of the cylindrical portion 110. Hook-shaped member 122 housing chamber 126 positions hook-shaped member 122 such that hook end 128 of hook-shaped member 122 extends beneath the lower surface 109 of first portion 108.

Hook-shaped member 122 is spring biased by a spring member 130. The spring member 130 is housed in the cylindrical portion 110 and anchored proximate the far end 111 of member 110 by pin 132. Pin 132 is positioned within cylindrical member 110 essentially parallel to hook-shaped member 122. The spring 130 is anchored to hook-shaped member 122 by pin 134. Pin 134 is connected to hook-shaped member 122 and is oriented basically perpendicular to the hook-shaped member 122. Spring member 130 biases the hook end 128 of hook-shaped member 122 toward U-shaped member 112 at the end of first portion 108 of upper scissors grip member 30.

Lower scissor grip member 32 is generally cylindrical and is connected at one end to rear elongated member 40. A spring member 133 is connected to lower scissor grip member at 135 and to both the left and side wall members 42 and 44 at vertical cut-outs 137. Spring 133 biases upper scissor grip member 30 away from lower scissor grip member 32.

Means are provided for setting the predetermined tension limit in each band 252 looped about an article 254 (FIG. 1), and for precisely determining and locking that predetermined tension in the looped band 252 about an article 254 when that tension limit has been attained. In FIGS. 2 and 5, the tension actuator unit 28 consists of an actuator housing 138, a spring member 140 positioned inside the housing 138, a connection member 142, a yoke 144 and a cylindrical pivot pin 146.

As illustrated in FIG. 5, the generally rectangular actuator housing 138 has a generally rectangular upper wall 148, a generally rectangular bottom wall 150, two generally rectangular side walls 152, 154, a generally rectangular end wall 156 and an open end 158. The upper wall 148 has a rectangular cut-out 160 approximately centered between the two side walls 152, 154 and contiguous with the open end 158 of the housing 138. This rectangular cut-out portion 160 interfaces with the hook-shaped member 122 extending through upper scissors grip 30.

The side walls 152, 154 of the actuator housing 138 have approximately identical rectangular cut-out portions 162, 164. The length of these side wall cut-out portions 162, 164 is critical to the operation of the tool 20. Cut-outs 162, 164 must be coordinated with the amount of tension provided by the spring 140 housed in the housing unit 138. The ends 166, 167, 168, 169 of each rectangular side wall cut-out portion 162, 164 are approximately semi-circular in shape.

The bottom wall 150 of the actuator housing 138 is also provided with a large generally rectangular cut-out portion 170. The cut-out portion 170 is contiguous with the open end 158 of the actuator housing 138 and extends approximately half way toward the closed end 156 of the actuator housing 138. The cut-out 170 extends from the inner surface 153 of side wall 152 to the inner surface 155 of side wall 154.

Attached to the outer surface 172 of the end wall 156 of the actuator housing 138 is a pivot housing 174. The pivot housing 174 has aperture 176 for receiving a pin joint 178 to connect the actuator unit 28 operatively to the upper scissor grip 30 and the two side walls 42, 44.

The upper wall 148, the two side walls 152, 154, the bottom wall 150 and the end wall 156 combine to form a generally cylindrical chamber 180 which houses the spring member 140. The spring member 140 is assembled in the housing 138 on a connection member 142. The connection member consists of a cylindrical member 182 having a stud 184 in the center of one end 185 of the member 142 and a collar 186 about the end 185 closest the stud 184.

A U-shaped yoke 144 retains spring member 140 in place in the housing 138. The yoke 144 is connected to both the first gripping element 24 and the upper scissors grip 30. The yoke 144 has connecting pins 188, 190 connected to the U end 192 of the yoke 144. The connection pins 188, 190 are connected by the links 48 to the first gripping element 24, by the connecting pin 178. The yoke 144 has two legs 194, 196 which extend perpendicular to the two connection pins 188, 190. The two legs 194, 196 of the U-shaped yoke have apertures 198, 200 located proximate the ends remote from the U end 192 of the yoke 144 for receiving a pivot pin 146. The U-legs 194, 196 of the yoke 144 are spaced so that they fit snugly but are freely slidable within the space defined by the inner surface 153, 155 of left and right walls 152, 154 of the tension element housing 138.

The cylindrical shaped pivot pin 146 which connects the yoke 144, and the connection member 142 has a recess 204 bored midway on its surface perpendicular to its length. This recess 204 is sized to receive snugly the stud 184 on the end 185 of the connection member 142.

Figure 8:
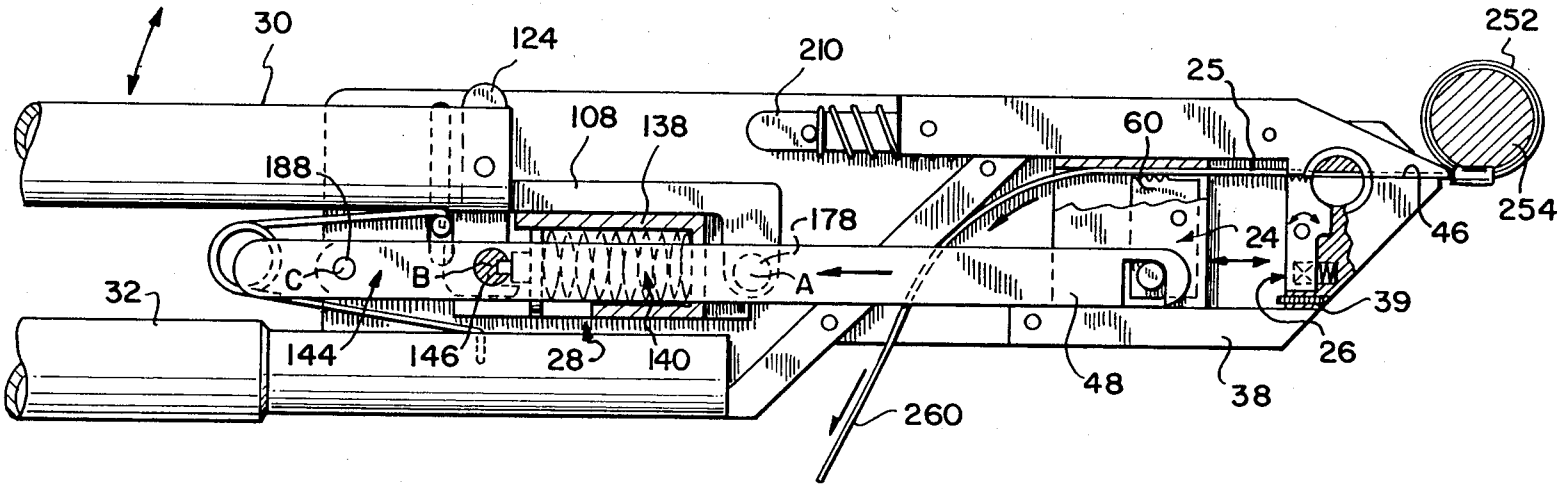
FIG. 8 is a view similar to FIG. 7 which illustrates the action of the upper gripping member and tension actuator to pull the banding material tighter about the article.
Figure 6:
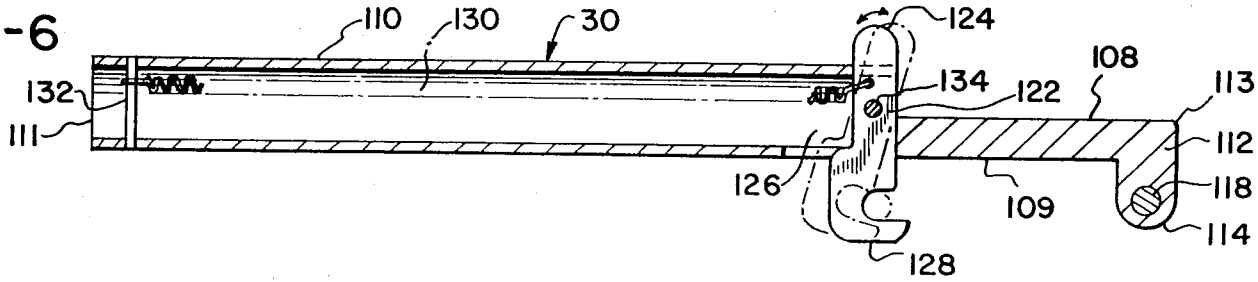
FIG. 6 is a detailed sectional view of the upper gripping member.
Figure 7:
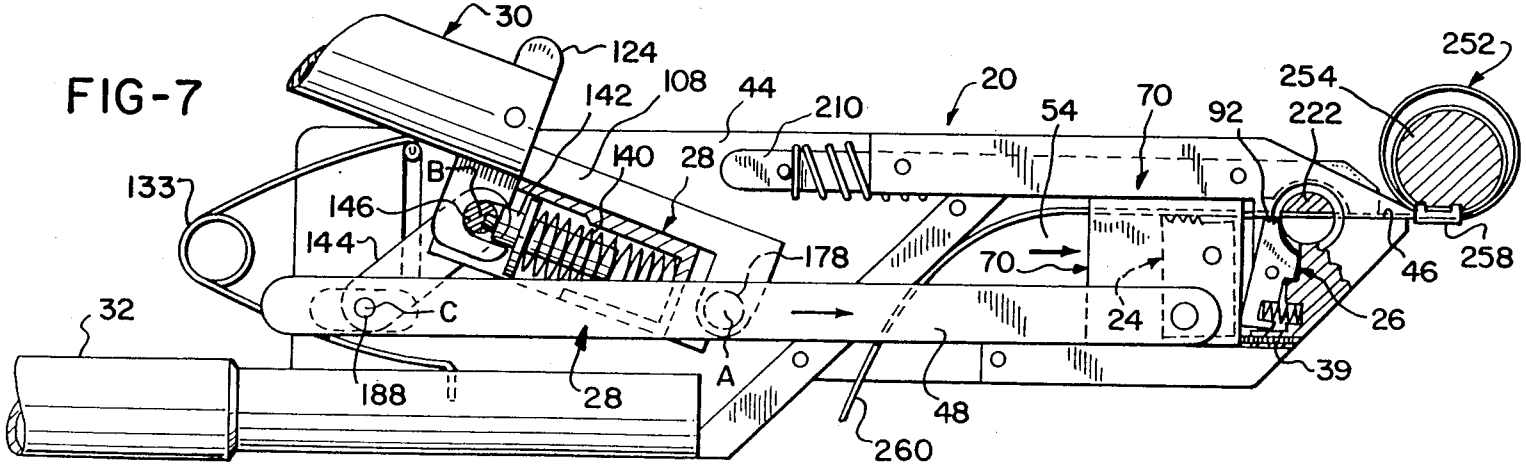
FIG. 7 is a partial sectional side view showing the tool of FIGS. 1–6, prepared for operation.

The pivot pin 146 extends through the yoke legs 194, 196 and overlaps the rectangular cut out portions 162, 164 in the two side walls 152, 154 of the actuator housing 138 but does not extend beyond the outer limits of the rectangular cut-off portions 162, 164 of the tension housing walls 152, 154. The hook end 128 of hook-shaped member 122 engages pivot pin 146 as shown in FIGS. 6–8.

Means are provided for bending the banding material 25 once the predetermined tension is locked into the band 252 about the article 254. In the embodiment illustrated in FIGS. 2 and 10, bending member 206 consists of a spring member 208 mounted on elongated member 210. The spring 208 biases elongated member 210 in the direction of flow of banding material 25 into tool 20. Two studs 212 and 214 are formed at one end perpendicularly to the surfaces 211 of member 210. Chamfered tip 216, positioned at the opposite end of elongated member 210 from studs 212, 214, is utilized to bend banding material 250. In close proximity to tip 216 is a recess 218.

Bending member 206 is housed in a chamber 220 located in upper receiving housing 34. Chamber 220 extends the entire length of the upper receiving housing 34 and is positioned therein approximately parallel to and above channel 46.

Means are provided for severing the banding material 25 once the banding material has been bent by bending member 206. In the embodiment illustrated in FIGS. 2 and 15, cutting member 222 consists of a generally cylindrical member 224 having a recess 226 extending approximately half way through the cylinder and having sharpened edges 232 and 234. Two end members 226 and 228 are integral with cylindrical member 224. A connecting member 236 is utilized to connect cylindrical member 224 to an actuator lever 238 (FIG. 1). The recess 218 in elongated member 210 cooperates with cylindrical member 224 during the bending operation.

Actuator lever 238 consists of an elongated rectangular member 240 having a curved end portion 242 at one end and a rectangular member 244 having an aperture 245 at the other end. Curved end portion 242 is curved away from side wall 42 of the housing group 22. Cylindrical member 224 of cutting member 222 is connected to rectangular member 244 of actuation lever 238 by connection member 236 into the aperture 245. Spring member 246 is positioned between rectangular member 244 and cylindrical member 224 to bias the actuator lever 238 toward linking member 48. Screw 246 is then inserted into cylindrical member 244 to complete the assembly.

While the components of the banding tool have been machined to a very close designed tolerance, in order to insure that the precise degree of required predetermined tension is actually generated by the tool 50, prior to releasing the assembled tool 50 from the factory, it is necessary to test the actual tension generated by the tension actuator 28.

If the results of the tension test indicates that the actual tension pulled by the tool 50 is within the designed predetermined tension range, the tool 50 may be shipped without further modification or adjustment.

However, if the tension generated in the test is greater than the tension for which the tool 50 was designed to generate, a means for adjusting the predetermined tension to within the required predetermined limits must be provided.

Figure 15:
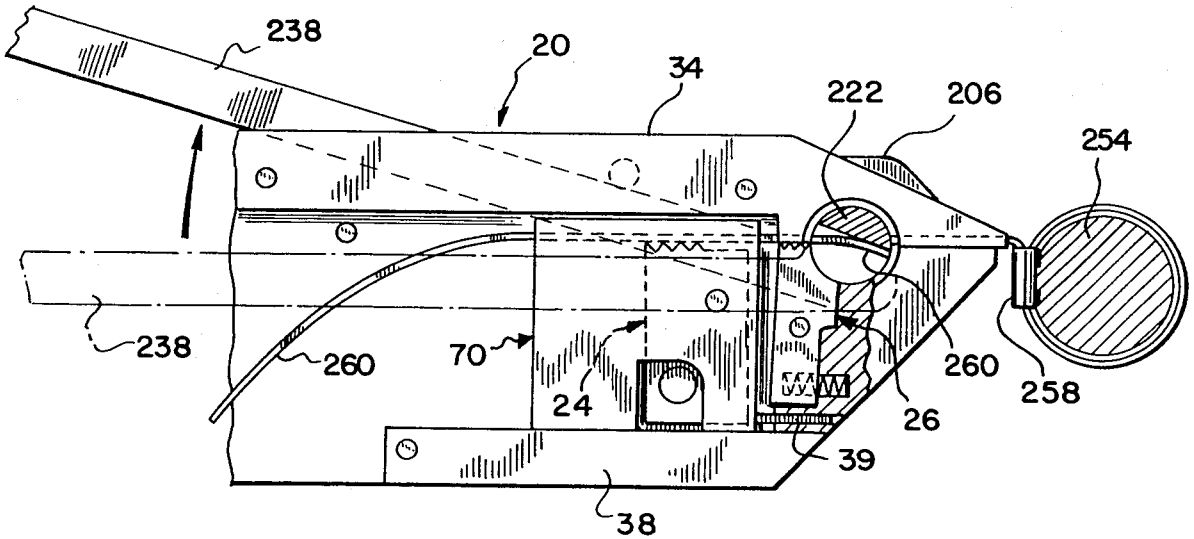
FIG. 15 is a portion sectional side view showing the operation of the cutter member.

In the embodiment illustrated in FIG. 15, this consists of a small adjustment screw 39 which is inserted into a threaded bore 37 in lower receiving member 36. Adjustment screw 39 is advanced into chamber 54 until contact is made with one or both of the side walls 72, 74 of the first gripping member housing 70. The limiting screw 39 is advanced a certain amount and the maximum tension generated by the actuator unit 76 is once again tested. This process is repeated until the maximum tension generated by the actuator unit 76 is adjusted to within the limitations required by the particular application.

It has been found that by limiting the travel distance of the first gripping member 24 within chamber 54, the tension generated by the gripping tool 50 can be fine tuned to within a specific predetermined range. Specifically, if the tension test indicates that excessive tension is being generated by the tool 50, during the final stroke which collapses the spring 140 of the tension actuator unit 26, then limiting screw 39 is advanced into chamber 54 to limit the travel of second gripping member housing 70 toward the first gripping member 26.

By limiting/adjusting the degree of travel of the second gripping member housing 70 within chamber 54, all dependent movement distances are also adjusted/shortened. Specifically, the degree of separation between upper scissors grip 30 and lower scissors grip 32 is shortened which in turn shortens the travel distance of linking members 48 in cut-outs 50, 52.

Once the upper tension limit is properly adjusted by the above method, the adjustment screw 39 is rigidly affixed so that the required predetermined tension is locked into the tool 20. This can be accomplished by a number of methods.

One method currently utilized in precision tools is to place a certified seal over the adjustment screw 39. If the seal becomes broken or dislodged, the tool 20 is withdrawn from use and is immediately retested. Once it is determined that the tool 20 is within the predetermined tension limits, a new seal is placed over the adjustment screw 39 thereby certifying that the tool 20 is once again within the predetermined tension limits.

A second method which may be utilized after manufacture and testing but before shipment to insure that the proper predetermined tension range is maintained in the tool 20, is to apply lock tight to the adjustment screw at the factory.

The third method after the proper tension adjustment is made at the factory is to permanently lock the degree of travel into the tool 20. This is accomplished by drilling and tapping the adapter screw 39 so that the adjustment screw 39 tip cannot be further adjusted within the chamber 54 after the tool 20 is shipped from the factory.

All of these methods are acceptable to insure that the predetermined tension limits are present at shipment and are maintained within the required tolerances by the tool 20 in the field. Thus, since the predetermined tension ranges are accurately set within the tool, the amount of tension generated by the tool 20 is still totally operator independent.

Once banding tool 20 has been assembled, to place banding tool 20 into operation, as illustrated in FIGS. 7–10, a band 25 is wrapped in a loop 252 around an article 254. After the band tip 256 is inserted into the channel 46. This banding material 25 is hand fed into the tool 20 until it is engageable by the first gripping element 24. Once sufficient banding material 25 has been fed into the channel 46, the tool 20 is operated by compressing the upper scissor grip 30 toward the lower scissor grip 32 in a scissor-like stroke. A plurality of such scissor-like strokes tightens the band 252 about the article 254 to the predetermined tension.

Figure 9:
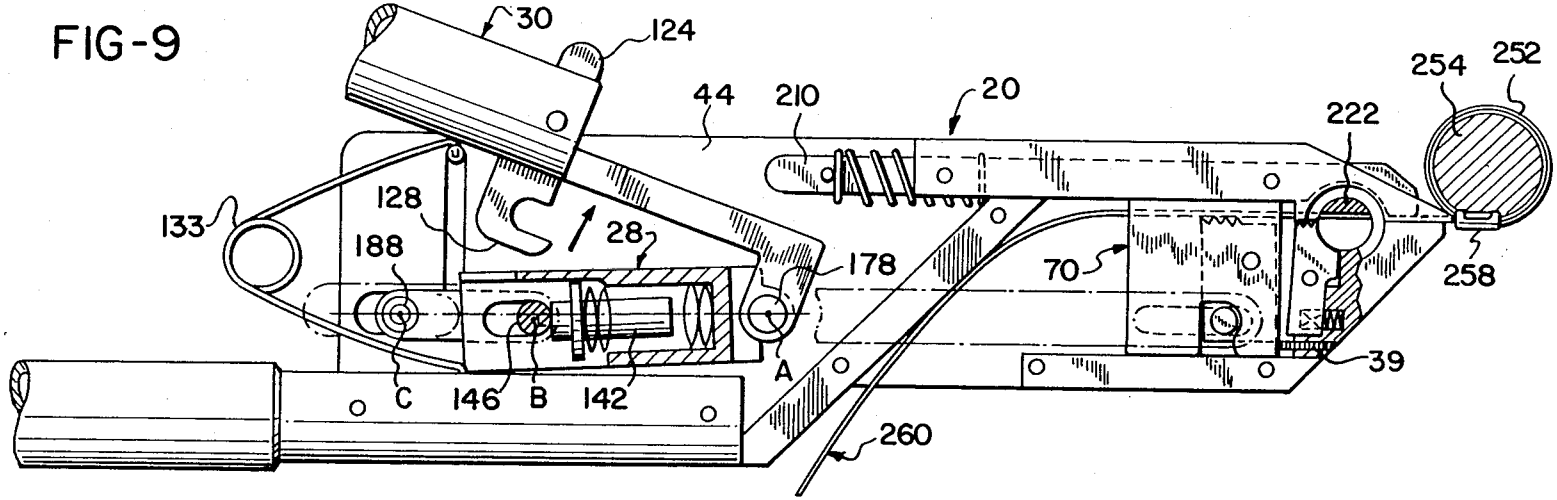
FIG. 9 is a view similar to FIGS. 7–8 which illustrates the banding material reaching its predetermined tension about the article and the locking of that tension by the actuating unit.
Figure 10:
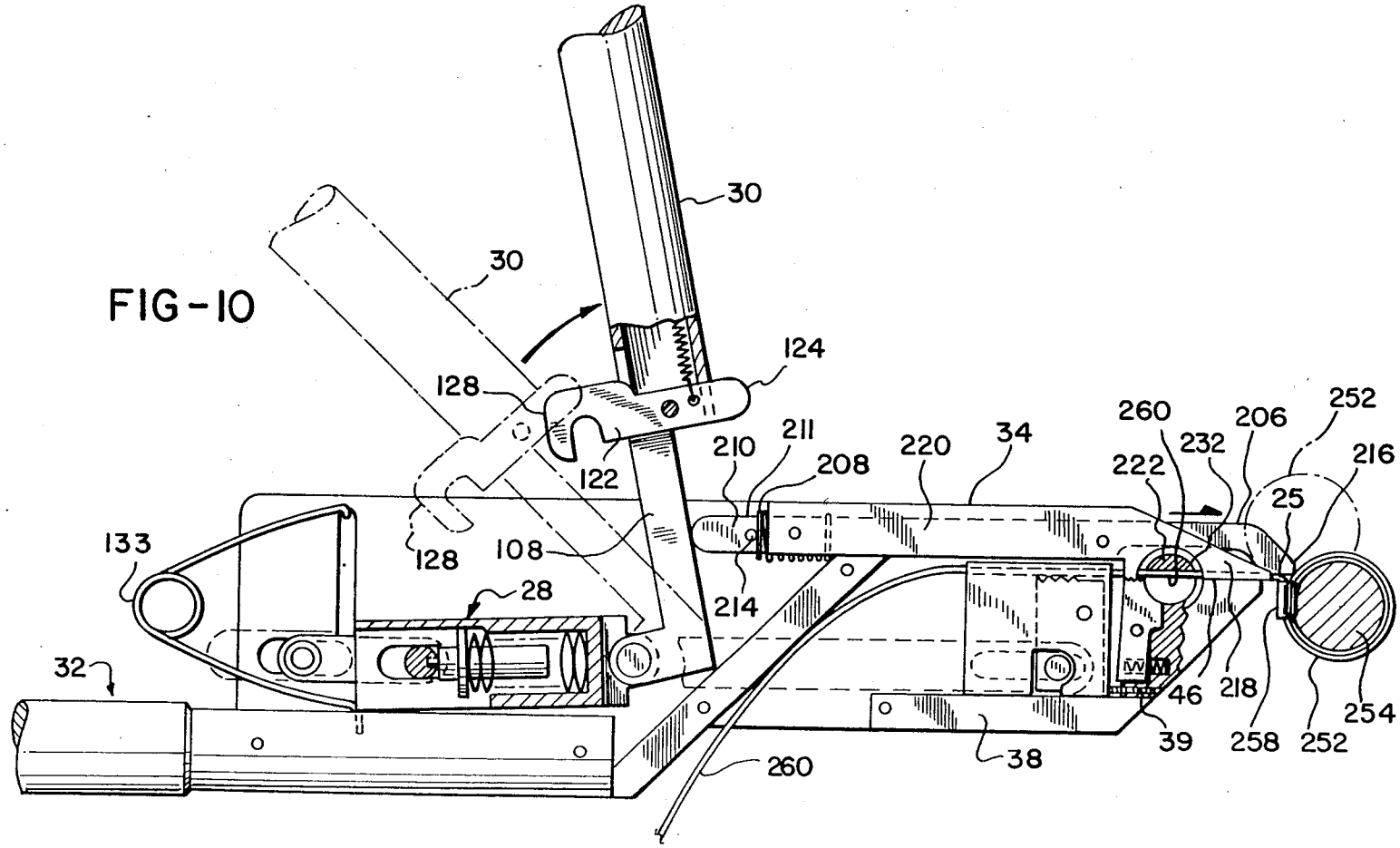
FIG. 10 is a view similar to FIGS. 7–9 illustrating the operation of the bending member.
Figure 11:
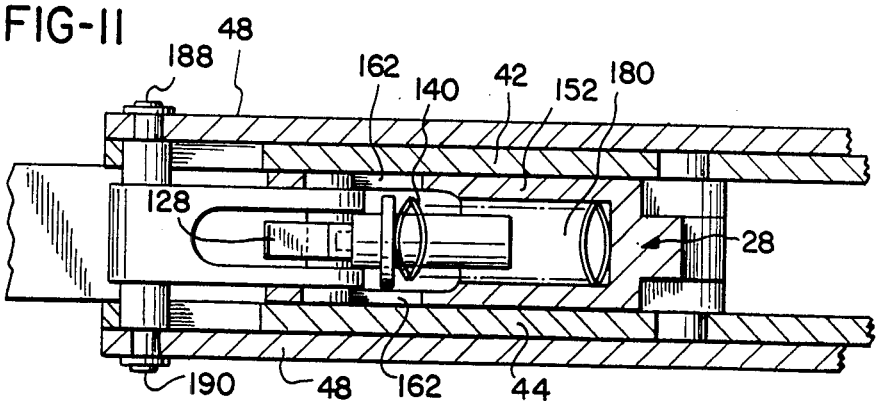
FIG. 11 is a partial sectional top view showing the connection between the hook-shaped member connected to the upper scissors member and the pivot joint which connects the yoke arms and the connecting member prior to the spring member collapsing when the predetermined tension is attained.

As best illustrated in FIG. 9, once the predetermined tension about the article 254 has been attained, the upper scissors grip 30 will disengage from the tension actuator units 28 pivot joint 146. Once disengaged from the pivot joint 146, the upper scissor grip 30 is rotated upwardly away from the lower scissors grip 32, as illustrated in FIG. 10, as far as possible. The upper scissors grip 30 will strike the spring biased bending member 206 and move its tip 216 into contact with the banding material just above the tip of the nose formed by housing parts 34 and 36.

As best illustrated in FIG. 10, this contact will roll the banded article 254 around the housing nose and thereby bend the banding material projecting beyond the buckle 258 at approximately a 90° angle. Once the banding material 25 has been bent, the predetermined tension on the band 252 about the article 254 will be maintained by the bend around the side of the band buckle 258. Specifically, the approximate 90° angle bend is critical to prevent the loop from loosening about the article 254 and to prevent this loop from slipping back away from the bend, thereby maintaining the predetermined tension about the article 254.

After the banding material 25 has been bent, the upper scissors grip 30 is returned to the position illustrated in FIG. 8 for reengagement with the acutator unit 28. In this position, the hook-shaped member 122 of upper scissor grip 30 is best positioned for reconnection to the tension actuator unit 28 at the pivot pin 146. If the hook-shaped member 122 and upper scissor grip 30 were not spring biased, after the tension had been released and the spring 140 returned to its original expanded position in actuator housing 138, it would require considerable pressure to compress the spring 140 in the actuator housing 138 to effect reengagement of hook-shaped member 122 with the pivot joint 146. While it is understood that hook-shaped member 122 can be rigidly affixed to the upper scissor grip member 30, a spring-biased member 112 is preferred in order to reduce tool breakage at this critical connection point.

In order to separate the excess banding material 260 contained in the tool 20 from the band 252 about the article 254, the actuating lever 238 (FIG. 15) for the cutting member 222 is rotated approximately in the same manner as the upper scissors grip 30. This upward motion, which is limited by member 237, rotates one of the cutting member's sharpened edges 232, 234 into contact with the banding material 25, severing it at a predetermined distance from the band buckle 258. The distance from the point of severance to the buckle 258 is such as to leave a corresponding length of banding material extending from its bend around the buckle 258.

Once the excess material 260 has been severed from the band 252, the excess banding material 260 which is being fed out from underneath the tool 20 is thrust sharply forward, causing the material 250 to bend about the lower elongated member 38.

To clear the excess banding material 260 from the channel 46, merely compress the scissor grips 30, 32 together in the scissor-like motion so that the teeth 62, 92 disengage from the excess banding material 260. Once all excess banding material 260 has been cleared, it may be discarded. At this point, the tool 20 is ready to begin another banding operation.

It is critical to the operation of the tool 20 that each component part cooperate in a specific manner. As illustrated in FIG. 7, upon engagement of the banding material 25 fed through the channel 46 by the first gripping member 24, the banding tool 20 is prepared for operation. In this position, the first gripping element 24 is all the way to the front of its operating chamber 54, contacting or nearly contacting the second gripping element 26. The teeth 92 on the second gripping member 26 are engaging the banding material 25 thereby preventing it from being disengaged from the banding tool 20.

Figure 13:
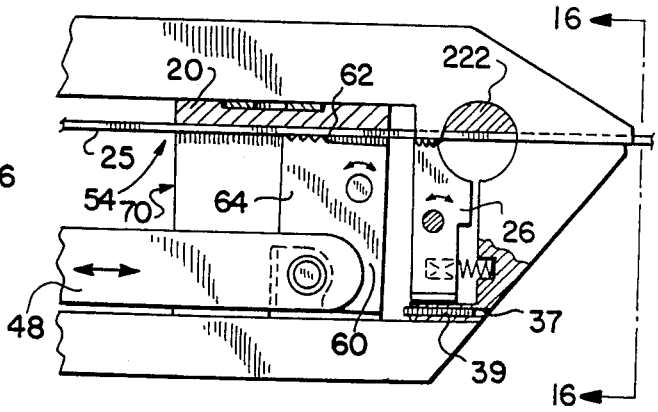
FIG. 13 is partial sectional side view showing the detailed inner relationship of the first and second gripping elements.

As best illustrated by FIGS. 8 and 13, during compression of the upper scissors grip member 30 to the lower scissors grip member 32, the first gripping member 24 inside the gripping member housing 70 is rotated slightly so that its teeth 62 engage the banding material 25. At that point of engagement, the banding material 25 is pulled away from the second gripping element 26 toward the tension actuator unit 28.

As best illustrated in FIGS. 7 and 8, the tension actuator unit 28, in combination with the pair of scissor-like grip members 30, 32 and the first gripping element 24 generate the power to draw the banding material 25 through the channel 46 into the tool 20. At some point during this process once the predetermined tension is attained, the tension actuator unit 28 in combination with the first gripping unit 24 automatically locks the banding material 25 into position about the banded article 254.

As best illustrated in FIG. 7, during the upstroke of the upper scissor grip member 30, three pivots A, B & C, pivot A being formed by the pin joint 178 connecting the actuator element 28 to the upper scissor grip member 30 and the side walls 42, 44, pivot B being formed by the pivot pin 146 connecting the yoke 144 and the connection member 142, and pivot C being formed by the yoke 144 connecting pins 188, 190, form a triangular relationship A, B, C.

As is illustrated in FIG. 8, on the downstroke or compression stroke, this triangular relationship A, B, C is converted into a linear relationship A, B, C. The transition from the triangular relationship of FIG. 7 to the linear relationship of FIG. 8 compresses the spring 140 housed in the tension actuator unit housing 138 forcing the yoke 144 rearward in cut-outs 52.

Since the yoke 144 is connected to the first gripping element 24 by linking members 48, this action pulls the first gripping element 24 away from the second gripping element 26 in channel 54. This rearward movement of the first gripping element 24 advances the banding material 25 into the channel 46 thereby tightening the band loop 252 about the article 254.

Upon release of upside of the upper scissor grip member 30, the tool 20 returns to the position illustrated in FIG. 7 and unless the pedetermined tension has been attained or exceeded, the spring 140 inside the tension actuator unit housing 28 returns to its original uncompressed position. The relationship between the three previously defined pivots A, B & C is again triangular as shown in FIG. 7.

Upon return to this position, the first gripping member teeth 62 are again disengaged from the banding material 25. The second gripping member teeth 94 engage the banding material 25 preventing the banding material from slipping back out of the channel 46 toward the band loop 252 about the article 254.

Upon the second and each subsequent compression of the upper scissor grip 30, the first gripping member teeth 62 re-engage the banding material 25 and advance the banding material 25, second gripper member teeth 94 disengage the banding material 25 thereby incrementally increasing the tension about the article 254. With each motion, the triangle A, B, C formed by the three pivots transitions from a triangular relationship to a linear relationship since the two links 48 connecting the yoke 144 and the first gripping element 24 act to pull the first gripping element 24 away from the second gripping element 26 in channel 54. During each transition of the three pivots A, B & C from the triangular relationship A, B & C to its linear relationship A, B, C, the band 252 is further tightened about the article 254.

Figure 12:
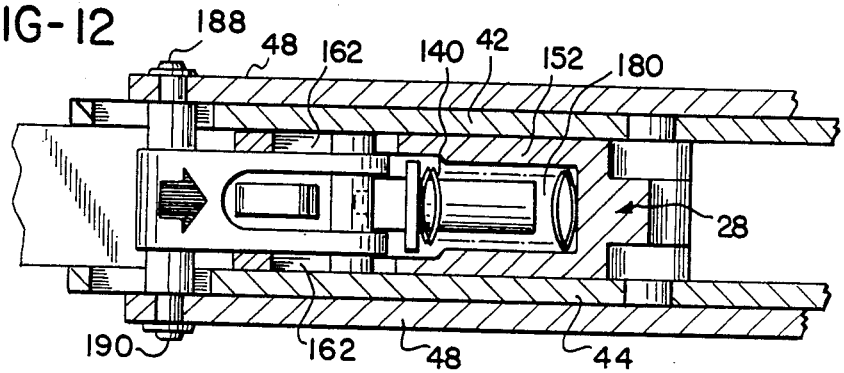
FIG. 12 is a partial sectional top view similar to FIG. 11 but showing the hook-shaped member disengaged from the pivot joint after the spring has collapsed inside the tension actuator housing once the predetermined tension has been attained.
Figure 16:
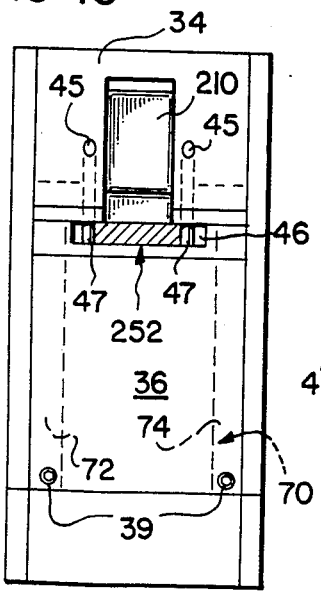
FIG. 16 is a partial view taken along the lines 15—15 of FIG. 13.

At some point during one of these scissor-like compression movements, the predetermined tension will be met or exceeded. The spring 140 will collapse inside the tension actuator housing unit 138, and the pivot joint 146 which connects the yoke 144 to the tension housing unit 138 will move all the way forward in the rectangular slots 162, 164 of the side walls 152, 154 as illustrated in FIGS. 9 and 12. Note, however, that since this can occur only on a compression stroke of member 30, the engagement between its part 108 and the housing 138 will force the latter down until the full compression stroke of member 30 has been completed.

In this position, as best illustrated in FIG. 9, the relationship of the three pivots will once again be triangular A, B, C. However, the pivot B of pivot pin 146 will be approximately 2° below center of a line connecting pivot A of connecting pin 178 and pivot C of yoke connecting pins 188, 190.

Once in this position, the collapsed compression spring 140 locks the predetermined tension in loop 252, and the upper scissor grip member 30 is simultaneously disengaged from the pivot joint 146 so the upper scissor grip member 30 can be used in the bending operation, as illustrated in FIG. 10.

In the preferred embodiment, due to their unique characteristics, Bellville washers are utilized as the spring member 140. Since the tension limit of Bellville washers stacked in series is determined by one washer and since no matter how many Bellville washers are stacked in series, the tension of all the Bellville washers is the same as a single washer, it is preferred to use a stacked series of Bellville washers for the spring member 140. However, as discussed earlier, it is possible to utilize any number of spring members such as for example, a coil spring, a rubber block, etc. with the invention.

It should be understood that with various spring members, it is possible to change the predetermined tension by changing springs and also to provide means for adjusting the predetermined tension within a range to a plurality of different tension values without physically changing springs.

Another unique feature of the tool concerns the disassembly and removal of the banding tool receiving housing 22 from the remainder of the tool 20. Should it become necessary to replace components housed in the upper receiving housing member 34, lower receiving housing member 36 or the lower elongated member 38, by merely removing three screws from each side member 42, and the retaining screw 246 retaining the actuating lever 38, the upper receiving housing member 34, the lower receiving housing member 36 and the lower elongated member 38 complete with the second gripping member 26 can be easily slid out from engagement between the wall members 42.

If maintenance is required on first gripping member 24, merely disconnecting linking members 48 at aperture 56 allows the entire first gripping member 24 to be removed from chamber 54 along with the above-mentioned components.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. An apparatus for tightening and securing banding material about an article within predetermined tension limits, said apparatus comprising:

means for receiving and guiding said banding material;

means operatively connected to said receiving and guiding means, for incrementally advancing said banding material about said article and including first and second grip members pivotally mounted with respect to one another;

means operatively connected to said advancing means, for securing said banding material within said apparatus as said banding material is being incrementally advanced;

means operatively connected to said advancing means, for precisely determining when said predetermined tension of said banding material about said article is reached;

means operatively connected to said advancing means for automatically locking and maintaining said banding material about said article when said band tension reaches said predetermined tension;

said means for precisely determining said predetermined tension of said banding material about said article further comprising a tension actuator unit having a tension actuator housing, said housing being operatively connected to said means for advancing said banding material, at least one spring member operatively positioned within said actuator housing, at least one connection member, said spring member being operatively positioned on said connection member within said housing, and a pivoting link means, said connection member being operatively connected to said link means, said link means being operatively connected to at least one of said grip members, said link means being operable to compress said spring member inside said tension actuator housing when said predetermined tension is attained on said banding material about said article.

2. The apparatus as recited in claim 1 further comprising means operatively connected thereto for bending said banding material after said predetermined tension has been locked about said article.

3. The apparatus as recited in claim 2 further comprising means for severing the excessing banding material from said band about said article.

4. The apparatus as recited in claim 1 wherein said means for receiving and guiding said banding material further comprises at least one housing member, said housing member having a channel formed therein and operatively connected to said means for incrementally advancing said banding material, said channel having an opening for receiving said banding material.

5. The apparatus as recited in claim 1 wherein said means for securing said banding material as said banding material is being advanced into said apparatus further comprises at least two gripping elements, with one of said gripping elements being operative to increase the tension of said banding material about said article, and with the second of said gripping elements being operable to prevent said banding material from losing said tension about said article after said banding material has been incrementally advanced and before the next incremental advancement.

6. The apparatus as recited in claim 5 wherein the first of said gripping elements further comprises:

a gripping member having a plurality of saw like teeth, said gripping member having bores for receiving at least one pivot pin and at least one connecting pin; and a gripping member housing, said housing having a top portion and at least two side portions having bores for receiving at least one pivot pin and at least one connecting pin, said gripping member being pivotally connected to said two side portions of said housing by said pivot pin, said bores for receiving said connecting pin being designed for precisely controlling the degree of movement of said gripping member within said housing, said gripping member housing having a recess positioned on the top surface of said top portion, said gripping member housing being operatively positioned within said apparatus such that said gripping member housing and said gripping member are movable as a unit within said apparatus to tighten said banding material about said article.

7. The apparatus as recited in claim 6 wherein when said banding material is being tightened about said article, said first gripping member teeth engage said banding material, and when said banding material is not being tightened about said article, said first gripping member teeth are out of engagement with said banding material.

8. The apparatus as recited in claim 6 wherein said first gripping element further comprises a spring washer member, said washer being operatively positioned within said recess on said top surface of said top portion of said gripping member housing, said washer maintaining tension drag between said gripping member housing and said apparatus during movement of said gripping member housing within said apparatus.

9. The apparatus as recited in claim 5 wherein the second of said gripping elements further comprises:

a gripping member having an upper surface with a plurality of saw like teeth and a depending boss having a bore for receiving a connecting pin; and a spring means positioned in engagement with said gripping member and said apparatus about said connecting pin for urging said teeth into engagement with said banding material, said gripping member being operatively positioned within said apparatus such that said gripping member is movable within said apparatus to grip and maintain tension in said banding material about said article.

10. The apparatus as recited in claim 1 wherein said tension actuator housing is operatively connected to at least one of said grip members, and said pivoting link means includes a yoke, with said predetermined tension causing said spring member to collapse inside said actuator housing when said banding material tension reaches said predetermined tension, and said yoke being disengageable from said grip member when said predetermined tension is attained.

11. The apparatus as recited in claim 1 wherein said pivoting link means includes an over-center toggle member, with said predetermined tension causing said spring member to compress inside said actuator housing when said banding material tension reaches said predetermined tension, and said link means and said connection member moving relative to said actuator housing to move said toggle member over-center.

12. A tool for tightening a band to a predetermined tension about an article by pulling said band through a buckle thereon, comprising:

(a) means defining an elongated housing having a nose at the front end thereof provided with a slot for admitting the end of a band to the interior of said housing;

(b) reciprocable feeding means within said housing for gripping, incrementally pulling said band into said housing, and then releasing said band, (c) means within said housing for gripping said band in response to release of said band by said feeding means;

(d) handle means for operating said feeding means;

(e) said feeding means including an element supported for reciprocating movement in said housing, (f) a lever arm pivotally connected at one end to said element;

(g) means forming a pivotal connection between the other end of said arm and said handle whereby pivotal movement of said handle causes said arm to move toward and away from parallel alignment with said element to reciprocate said element; and (h) means for separating said handle from said pivotal connection in response to a predetermined tension in said band following engagement with said nose by said buckle.

13. The tool defined in claim 12 wherein said arm is connected to move through a centered position with respect to said element, and said releasing means operates following movement of said arm into over-center relation with said element to hold said feeding means at the end of a pulling stroke thereof upon release of said handle.

14. The tool defined in claim 12 wherein said pivotal connection forming means and said separating means include a pivot member on said other end of said arm, an open hook on said handle means adapted to receive said pivot member therein from the front thereof, and means responsive to the tension in said band for releasably holding said pivot member in said hook.

15. The tool defined in claim 14 wherein said tension responsive means comprises a carrier member mounted for coaxial pivotal movement with said handle, a thrust member supported for movement on said carrier member radially of the pivotal axis thereof, and biasing means having a predetermined thrust force carried by said carrier member in said hook, whereby when the tension in said band exceeds said thrust force of said biasing means, said arm disengages said pivot member from said hook.

16. The tool defined in claim 15 wherein said biasing means comprises a plurality of Bellville washers supported on said carrier member in substantial alignment with said thrust member and the pivotal axis of said handle.

17. The tool defined in claim 16 wherein said arm is connected to move back and forth through a centered position with respect to said element, whereby said disengagement of said pivot member from said hook takes place while said arm is in over-center relation with said element to hold said feeding means at the end of a pulling stroke thereof upon release of said handle.

18. A tool for tightening a band to a predetermined tension about an article by pulling said band through a buckle thereon, comprising:

(a) means defining an elongated housing having a front end which is beveled to define a generally triangular nose, (b) said nose having a slot therein for admitting the end of a band to the interior of said housing, (c) reciprocable feeding means within said housing for gripping, incrementally pulling said band into said housing, and then releasing said band, (d) means within said nose for gripping said band in response to release of said band by said feeding means;

(e) handle means for operating said feeding means pivotally mounted in said housing and extending from within the rear thereof; and (f) means controlled by the tension in said band for maintaining an operative connection between said handle and said feeding means;

(g) said controlled means including means for releasing said operative connection following engagement with said nose by said buckle in response to a predetermined tension in said band.

19. The tool defined in claim 18 including pushing means positioned on said housing for actuation by said handle means while said operative connection is released for engaging the banded article in bending relation.

20. The tool defined in claim 19 wherein said releasing means includes a plurality of Bellville washers arranged in series for reponse to a predetermined extent of compression thereof by releasing said operative connection.

21. The tool defined in claim 18 wherein said operative connection includes an element supported for reciprocating movement in said housing, a lever arm pivotally connected at one end to said element, and means forming a pivotal connection between the other end of said arm and said handle whereby movement of said handle causes said arm to move toward and away from parallel alignment with said element to reciprocate said element.

* * * * *